US008864552B2

(12) United States Patent
Schmitz

(10) Patent No.: US 8,864,552 B2
(45) Date of Patent: Oct. 21, 2014

(54) CAMSHAFT-GRINDING MACHINE

(75) Inventor: Roland Schmitz, Vaihingen (DE)

(73) Assignee: EMAG Holding GmbH, Salach (DE)

( * ) Notice: Subject to any disclaimer, the term of this patent is extended or adjusted under 35 U.S.C. 154(b) by 470 days.

(21) Appl. No.: 13/172,420

(22) Filed: Jun. 29, 2011

(65) Prior Publication Data

US 2012/0009851 A1 Jan. 12, 2012

(30) Foreign Application Priority Data

Jul. 9, 2010 (DE) ..... 10 2010 026 663

(51) Int. Cl.
*B24B 5/42* (2006.01)
*B24B 19/12* (2006.01)

(52) U.S. Cl.
CPC ..... *B24B 19/125* (2013.01)
USPC ..... 451/11; 451/262; 451/399

(58) Field of Classification Search
USPC ..... 451/11, 210, 262, 269, 397, 398, 399, 451/49, 5, 57, 62, 83, 109
See application file for complete search history.

(56) References Cited

U.S. PATENT DOCUMENTS

| | | | | | |
|---|---|---|---|---|---|
| 1,933,016 | A | * | 10/1933 | Huse | 451/431 |
| 1,993,854 | A | * | 3/1935 | Ott | 451/239 |
| 2,017,875 | A | * | 10/1935 | Theler et al. | 451/244 |
| 2,113,509 | A | * | 4/1938 | Groene et al. | 82/109 |
| 2,127,210 | A | * | 8/1938 | Dunbar | 451/199 |
| 2,322,620 | A | * | 6/1943 | Ekholm | 451/242 |
| 4,215,962 | A | * | 8/1980 | Kreucher | 409/241 |
| 4,290,238 | A | * | 9/1981 | Judge, Jr. | 451/163 |
| 4,570,387 | A | * | 2/1986 | Unno et al. | 451/5 |
| 4,926,603 | A | * | 5/1990 | Frost et al. | 451/5 |
| 5,392,566 | A | | 2/1995 | Wedeniwski | |
| 5,667,432 | A | * | 9/1997 | Rollier | 451/242 |
| 5,720,652 | A | * | 2/1998 | Steinwender et al. | 451/254 |
| 5,865,667 | A | * | 2/1999 | Rollier | 451/11 |
| 5,906,534 | A | * | 5/1999 | Folkman et al. | 451/45 |
| 6,106,373 | A | * | 8/2000 | Fabris | 451/57 |
| 6,390,892 | B1 | | 5/2002 | Klicpera | |
| 6,409,573 | B1 | * | 6/2002 | Mukai et al. | 451/5 |
| 6,458,022 | B1 | * | 10/2002 | Folz | 451/365 |
| 7,597,035 | B2 | * | 10/2009 | Rehm | 82/157 |
| 8,286,955 | B2 | * | 10/2012 | Damang | 269/228 |
| 2010/0173565 | A1 | * | 7/2010 | Junker | 451/11 |
| 2010/0233939 | A1 | * | 9/2010 | Schmitz | 451/49 |
| 2010/0291837 | A1 | * | 11/2010 | Hessbrueggen | 451/5 |
| 2011/0306273 | A1 | * | 12/2011 | Tschudin et al. | 451/5 |
| 2012/0164926 | A1 | * | 6/2012 | Himmelsbach | 451/397 |

FOREIGN PATENT DOCUMENTS

| | | |
|---|---|---|
| GB | 2193457 A | 2/1968 |

* cited by examiner

*Primary Examiner* — Lee D Wilson
*Assistant Examiner* — Tyrone V Hall, Jr.
(74) *Attorney, Agent, or Firm* — Andrew Wilford

(57) ABSTRACT

An apparatus for grinding a cam having an outer surface with outwardly convex and outwardly concave portions has a frame and a main drive on the frame for holding the cam and rotating it about a main axis. A pair of drive motors having respective output axes generally diametrally flank the main axis. Respective carriages carrying the drive motors are shiftable on the frame radially of the main axis. One of the motors is shiftable into an inner position in which the main axis extends through the one drive motor. Respective grinding wheels are rotatable by the motors about the respective axes, and the wheel of the one motor is of substantially smaller diameter than the wheel of the other motor.

8 Claims, 2 Drawing Sheets

CAMSHAFT-GRINDING MACHINE

FIELD OF THE INVENTION

The present invention relates to a camshaft grinding machine.

BACKGROUND OF THE INVENTION

It is known to make a so-called assembled camshaft by precision-machining a plurality of individual cams and then fixing them on a shaft. The disks can be made by sintering and are ground to the desired shape, which typically has a circularly annular body with coaxial inner and outer peripheries and a cam lobe projecting radially from the outer periphery at one location. Thus the outer surface of the cam is mostly outwardly convex except in concave regions where the cam lobe merges with the otherwise circular outer periphery of the cam.

It is known from GB 2,193,457 to clamp a stack of such cam disks coaxially on a mandrel so that they can all be machined at the same time. This represents a substantial gain in productivity.

In U.S. Pat. No. 5,392,566 a system is proposed for grinding such a stack of cams by first grinding all the outwardly convex surfaces using a large-diameter grinding wheel, then in a second operation with a different grinder the concave surfaces are ground with a small-diameter wheel. This produces a quality product, but the two-step grinding process increases production costs and time.

A tapered grinding disk is used in EP 0 991 497 that, with some complex control issues, is capable of producing a high-quality product. While the product is fairly good, it is necessary to use special-duty tools and grinders.

OBJECTS OF THE INVENTION

It is therefore an object of the present invention to provide an improved camshaft-grinding machine.

Another object is the provision of such an improved camshaft-grinding machine that overcomes the above-given disadvantages, in particular that allows cams to be ground in a fairly simple machine and with a high degree of accuracy.

SUMMARY OF THE INVENTION

An apparatus for grinding a cam having an outer surface with outwardly convex and outwardly concave portions has according to the invention a frame and a main drive on the frame for holding the cam and rotating it about a main axis. A pair of drive motors having respective output axes generally diametrally flank the main axis. Respective carriages carrying the drive motors are shiftable on the frame radially of the main axis. One of the motors is shiftable into an inner position in which the main axis extends through the one drive motor. Respective grinding wheels are rotatable by the motors about the respective axes, and the wheel of the one motor is of substantially smaller diameter than the wheel of the other motor.

With this system therefore the cam is engaged diametrally oppositely by the two grinding wheels, thereby eliminating the problem of deflecting the workpiece during machining. In addition since according to the invention the two wheels are between the two motors, it is possible to work with a small-diameter wheel that can get into the concavities of the cam while not having to deal with the complex control issues of a tapered grinding tool.

BRIEF DESCRIPTION OF THE DRAWING

The above and other objects, features, and advantages will become more readily apparent from the following description, reference being made to the accompanying drawing in which.

DETAILED DESCRIPTION

Figure 1:
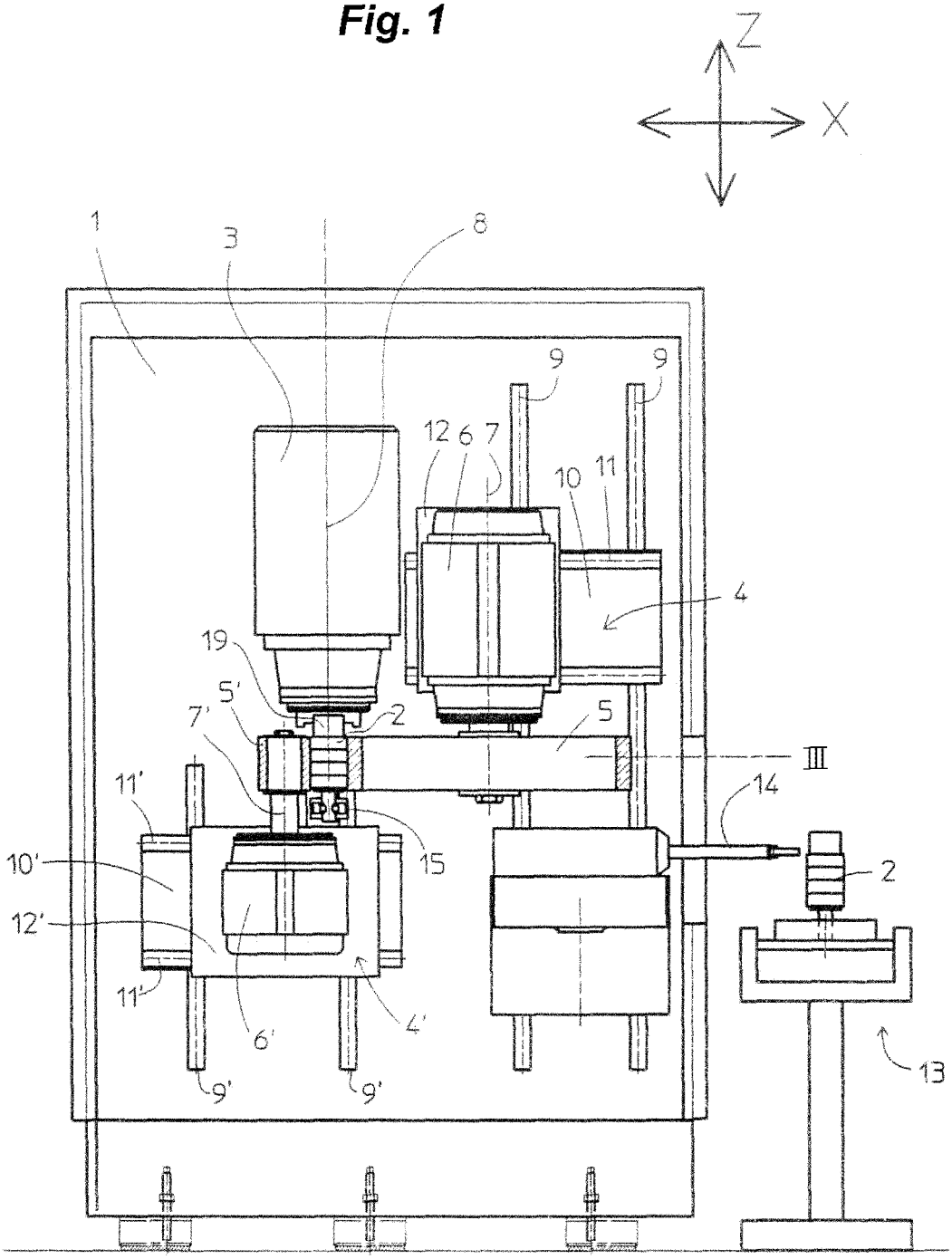
FIG. 1 is a schematic small-scale side view of the apparatus according to the invention.
Figure 2:
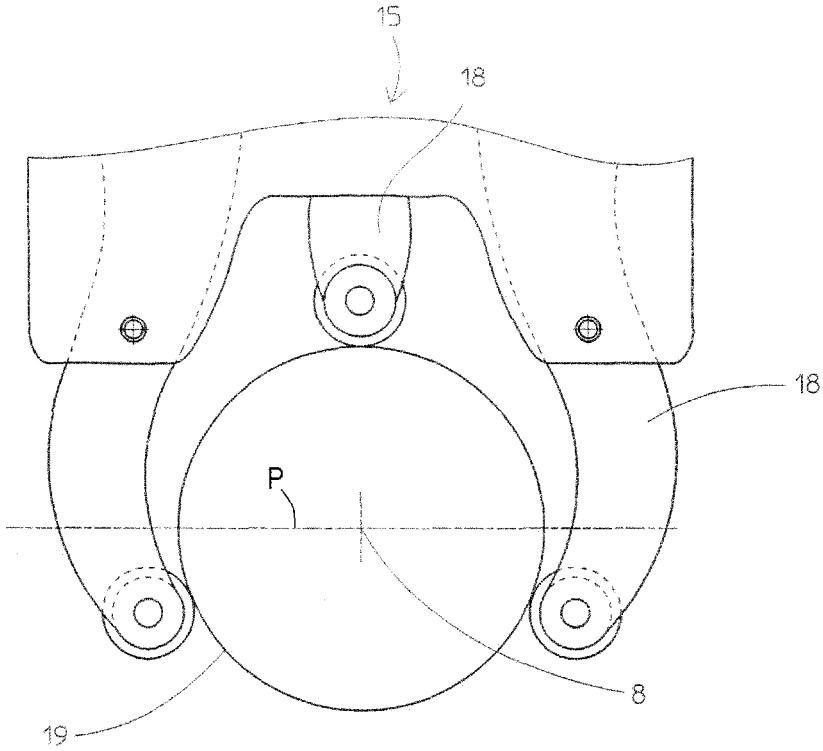
FIG. 2 is a large-scale bottom view of a detail of the apparatus.

As seen in FIG. 1 a grinder according to the invention has a stationary frame 1. Workpieces, here cams 2, are fixed on a shaft mandrel 19 that is fitted at its upper end into a chuck of a drive 3 for rotation about a vertical axis 8 and engaged at its lower end by a steady rest 15 having three arms 18 (FIG. 2) with rollers that are biased radially inward against the cylindrical outer surface of the mandrel shaft 19 to keep it centered on the axis 8. A grab 14 can pick mandrels 19 loaded with unmachined cams 2 off a conveyor 13 to load them into the machine and can take the machined cams out of the machine and place them on the conveyor 13 for movement to the next station.

According to the invention the frame 1 carries a first pair of vertical guide rails 9 and, horizontally offset therefrom, a second pair of vertical guide rails 9'. Respective vertically displaceable carriages 10 and 10' are carried on these rails 9 and 9' and in turn are provided with respective pairs of horizontal guide rails 11 and 11'. Respective horizontally shiftable carriages 12 and 12' supporting respective grinders 4 and 4' are carried on these rails 11 and 11' and in turn support respective electric drive motors 6 and 6' whose output shafts are centered on respective vertical axes 7 and 7'. These axes 7 and 7' flank, are parallel to, and lie in a plane P with the axis 8. Thus both the drives 6 and 6' can move horizontally in the X-direction and vertically in the Z-direction.

Figure 3:
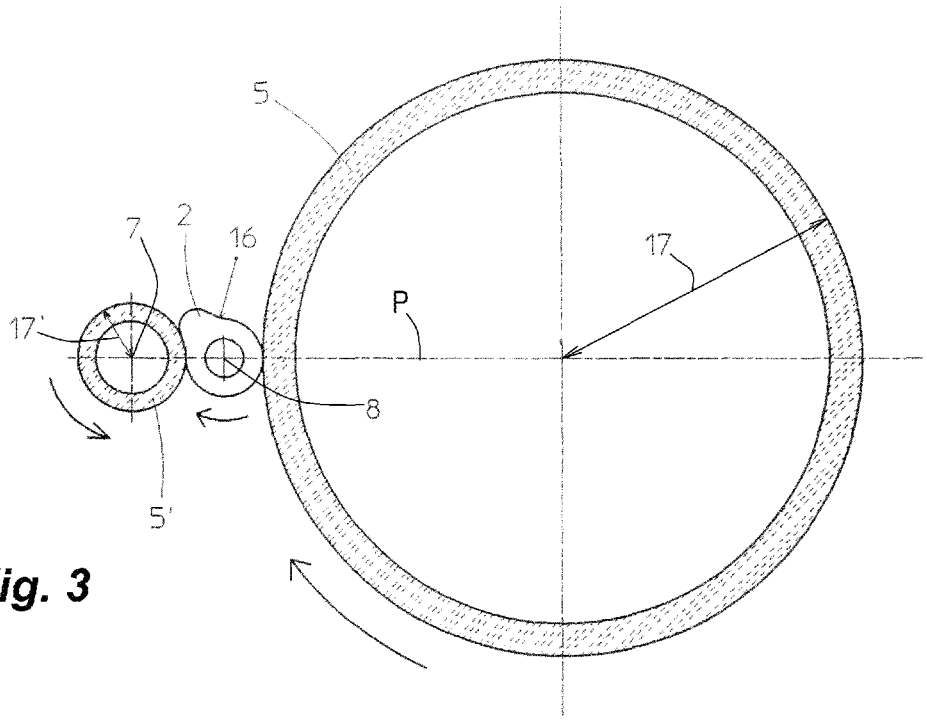
FIG. 3 is a section taken along plane III of FIG. 1.

In accordance with the invention as shown in FIG. 3 the drive 6 carries a grinding wheel 5 with a large diameter 17 and the drive 6' carries a grinding wheel 5' with a small diameter 17'. In addition the drive 6 with the large wheel 5 is generally level with the headstock drive 3. Due to the large diameter 17 of the wheel 5, this is possible. On the other hand, the drive motor 6' is located below the steady rest 15 and in fact overlaps the axis 8. Thus it is possible for its small-diameter wheel 5' to engage the outer surface of the cams 2 even though the drive motor 6' is of much greater diameter than the wheel 5'.

This setup has two significant advantages:

1. The use of grinding disks on opposite sides of the workpieces minimizes radial deflection and produces a more accurate product.
2. The use of one small-diameter disk and one large-diameter disk ensures fast grinding of the entire cam surface because the small disk can get into the concavities at the base of the cam lobe.

I claim:

1. An apparatus for grinding a cam having an outer surface with outwardly convex and outwardly concave portions, the apparatus comprising:

a frame;

means on the frame for holding the cam and rotating it about a main axis;

first and second drive motors having respective output axes generally diametrally flanking the main axis and lying wholly on opposite sides of a plane extending orthogonally through the axis;

respective carriages carrying the drive motors and shiftable on the frame radially of the main axis, the first motor being shiftable into an inner position in which the main axis extends through the one drive motor; and respective first and second grinding wheels rotatable by the motors about the respective axes generally at the plane, the wheel of the first motor being of substantially smaller diameter than the wheel of the second motor and also of smaller diameter than the first drive motor, the grinding wheels being, relative to the main axis, axially between the first and second drive motors.

2. The grinding apparatus defined in claim 1 wherein the small-diameter wheel of the one motor has a smaller radius than a radius of curvature of the concave surface portion, and the wheel of the other motor has a larger radius than the radius of curvature of the concave surface portion.

3. The grinding apparatus defined in claim 1, wherein the means for holding and rotating the cam includes a motor and headstock and, spaced therefrom along the main axis, a steady rest.

4. The grinding apparatus defined in claim 3 wherein the steady rest is, relative to the main axis, between the one motor and the cam.

5. The grinding apparatus defined in claim 3 wherein the headstock lies between the motor of the means for holding and the cam.

6. The grinding apparatus defined in claim 1, further comprising means for loading unmachined cams into the means for holding and for unloading machined cams from the means for holding.

7. The grinding apparatus defined in claim 1, wherein the means for rotating the cam includes a third drive motor lying to one side of the plane.

8. The grinding apparatus defined in claim 7, wherein the third drive motor and the second drive motor of the large-diameter grinding wheel are both on the one side of the plane and the first drive motor of the small-diameter grinding wheel is on the other side of the plane.

* * * * *